US010362848B1

(12) United States Patent
Caruso

(10) Patent No.: US 10,362,848 B1
(45) Date of Patent: Jul. 30, 2019

(54) UNIVERSAL NO-SLIP HAIRPIN

(71) Applicant: Elena Caruso, Boynton Beach, FL (US)

(72) Inventor: Elena Caruso, Boynton Beach, FL (US)

( * ) Notice: Subject to any disclaimer, the term of this patent is extended or adjusted under 35 U.S.C. 154(b) by 184 days.

(21) Appl. No.: 15/732,200

(22) Filed: Oct. 3, 2017

(51) Int. Cl.
*A45D 8/08* (2006.01)
*A45D 8/00* (2006.01)

(52) U.S. Cl.
CPC ..... *A45D 8/08* (2013.01); *A45D 2008/006* (2013.01)

(58) Field of Classification Search
CPC ... A45D 8/06; A45D 8/08; A45D 8/04; A45D 8/02; A45D 8/10; A45D 2008/006
See application file for complete search history.

(56) References Cited

U.S. PATENT DOCUMENTS

2005/0188998 A1* 9/2005 Salas ..... A45D 8/04 132/212
2009/0305054 A1* 12/2009 Huck ..... B05C 17/002 428/426
2011/0005547 A1* 1/2011 Tsai ..... A45D 8/08 132/275
2014/0096789 A1* 4/2014 Caruso ..... A45D 8/08 132/280
2014/0182616 A1* 7/2014 Johnson ..... A45D 8/08 132/275

FOREIGN PATENT DOCUMENTS

FR 339110 * 11/1904 ..... A45D 8/06
FR 471401 * 10/1914 ..... A45D 8/06
GB 15787 * 10/1914 ..... A45D 8/02

* cited by examiner

*Primary Examiner* — Blake A Tankersley

(57) ABSTRACT

A universal hairpin with a no-slip flocked coating is provided. The legs of the hairpin are covered with flocked coating of various heights for providing no-slip effect for a particular hair type. A hairpin has an interface for attaching a replaceable charm. The interface may use a screw tip, a Velcro™ lock, a clip, a clamp, a ring, a magnet, etc. The universal hairpin may have detachable tips of various shapes for different hair types or different types of hairstyles. The universal hairpin may have an asymmetric shape for more convenient use by a hairstylist and for providing enhanced in-hair hold.

13 Claims, 4 Drawing Sheets

UNIVERSAL NO-SLIP HAIRPIN

BACKGROUND OF THE INVENTION

Field of the Invention

This invention relates to an improved hairpin, and more particularly, to a universal no-slip hairpin with replaceable charms.

Description of the Related Art

Hairpins for holding hairdos in place and affixing wigs have been in use for over a hundred of years. A typical hair pin or hairpin is a prolonged-shape device generally used to hold a person's hair in place by being placed between the hairs. The hairpin may be used simply to secure long hair out of the way for convenience or as part of an elaborate hairstyle, hairdo or coiffure. Creation of different hairstyles, especially among women, seems to be common to all cultures and all periods, and many past and current societies use hairpins. Hairpins made of metal, ivory, bronze, carved wood, etc. were used in ancient Assyria and Egypt for securing decorated hairstyles. Major success came in 1901 with the invention of the spiral hairpin by New Zealand inventor Ernest Godward who produced a first hairpin that would not easily fall out of the hair.

The hairpin may be decorated with charms and encrusted with jewels and ornaments, or it may be utilitarian, and designed to be almost invisible while holding a hairstyle in place. Some hairpins are implemented as a single straight pin, but modern versions are typically constructed from different lengths of wire that are bent in half with a u-shaped end and a few kinks along the two opposite portions. The finished pin may vary from two to six inches in final length. The length of the wires, referred to as hairpin legs, enables placement in several styles of hairdos to hold the style in place. The kinks or waves are intended to enable retaining the pin in the hair during normal movements.

In the past, women used to wash their hair once in a few days if not weeks. Frequent bathes and hair washes were considered unhealthy for the hair. As a result, women used hairpins on sick, greasy and sticky hair or wigs that provided for sufficient grip of a simple wire-based hairpin. The hairdo or the wig stayed in place during moving or even dancing due to the structure and condition of the hair. However, modern culture and means of hair hygiene make conventional hairpins very unreliable if not unusable. Modern women wash their hair every day using very strong shampoos and conditioners that produce beautiful soft, slick and silky hair. Keeping this hair in place by a conventional hairpin may present a challenge, because a conventional hairpin would not simply stay in and may slip out when a person moves or shakes his or her head. Shortcomings of the conventional hairpins become more apparent given the activities modern women engage into on a regular basis, such as dancing, aerobics, swimming, running, playing games just to name a few. Accordingly, a simple, inexpensive and reliable no-slip hairpin is desired.

Many modern hairpins are decorated with charms. However, if a lady wants to use different charms, she needs to have several different hairpins which may not be convenient. Additionally, if hairpins with different shape of the tips that initially penetrate into the hair are needed by a hairstylist, he or she would need to have a number of them. Accordingly, a universal hairpin with replaceable charms and changeable profiles of the hairpin tips is highly desirable.

SUMMARY OF THE INVENTION

Accordingly, the present invention is directed to an improved no-slip universal hairpin that substantially obviates one or more of the disadvantages of the related art.

In one of the aspects of the invention, a universal hairpin with a no-slip flocked coating is provided. The legs of the hairpin may be covered with flocked coating of various heights for providing no-slip effect for a particular hair type.

In another aspect of the invention, a hairpin has an interface for attaching a replaceable charm. The interface may use a screw tip, a Velcro™ lock, a clip, a clamp, a ring, a magnet, etc. The universal hairpin may have detachable tips of various shapes for different hair types or different types of hairstyles. The universal hairpin may have an asymmetric shape for more convenient use by a hairstylist and for providing better hold in the hair.

Additional features and advantages of the invention will be set forth in the description that follows, and in part will be apparent from the description, or may be learned by practice of the invention. The advantages of the invention will be realized and attained by the structure particularly pointed out in the written description and claims hereof as well as the appended drawings.

It is to be understood that both the foregoing general description and the following detailed description are exemplary and explanatory and are intended to provide further explanation of the invention as claimed.

BRIEF DESCRIPTION OF THE ATTACHED FIGURES

The accompanying drawings, which are included to provide a further understanding of the invention and are incorporated in and constitute a part of this specification, illustrate embodiments of the invention and together with the description serve to explain the principles of the invention.

DETAILED DESCRIPTION OF THE PREFERRED EMBODIMENTS

Reference will now be made in detail to the preferred embodiments of the present invention, examples of which are illustrated in the accompanying drawings.

In one embodiment, a hairpin with an anti-slip coating is provided. In one of the aspects of the invention, a universal hairpin with a no-slip flocked coating is provided. The legs of the hairpin may be covered with flocked coating of various flock heights for providing no-slip effect for a particular hair type.

In another aspect of the invention, a hairpin has an interface for attaching a replaceable charm. The interface may use a screw tip, a Velcro™ lock, a clip, a clamp, a ring, a magnet, etc. The universal hairpin may have detachable tips of various shapes for different hair types or different types of hairstyles. The universal hairpin may have an asymmetric shape for more convenient use by a hairstylist.

Figure 1:
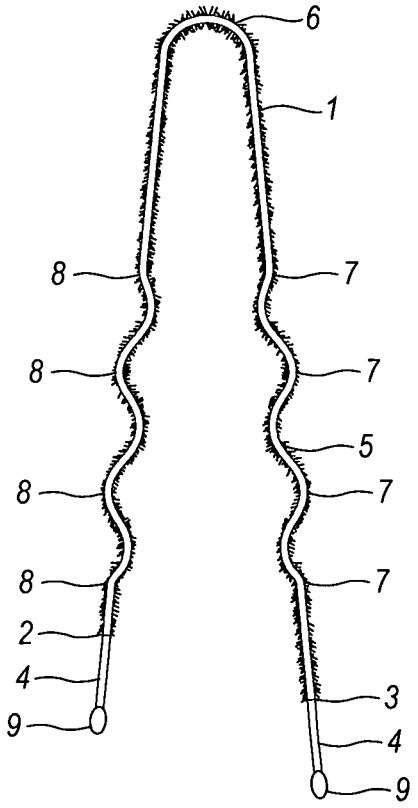
FIG. 1 illustrates a universal hairpin with a no-slip coating, in accordance with the exemplary embodiment.

FIG. 1 illustrates a universal hairpin with a no-slip coating, in accordance with the exemplary embodiment. A body of a hairpin 1 can be made of a metal wire, plastic or polymer material. The body of the hairpin 1 comprises legs 2 and 3 of different length. According to the preferred embodiment, the body of the hairpin 1 is covered with a no-slip coating 5 from its top 6 all the way down the both legs 3 and 4 except uncovered bottom portions 4 that need to remain slick for ease of penetrating in between the hairs. As can be seen from the FIG. 1, the legs 2 and 3 have different length thereby creating an asymmetric shape. The asymmetry of the hairpin shape produces a larger no-slip coated surface of hair contact that results in a firmer hold of the hairpin in the hair. Note that the waves 7 and 8 of the hairpin legs 3 and 4 are offset for producing yet even better grip. In the example depicted in FIG. 1, a body of a hairpin 1 has replaceable ball tips 9 attached to both legs 3 and 4.

Figure 2:
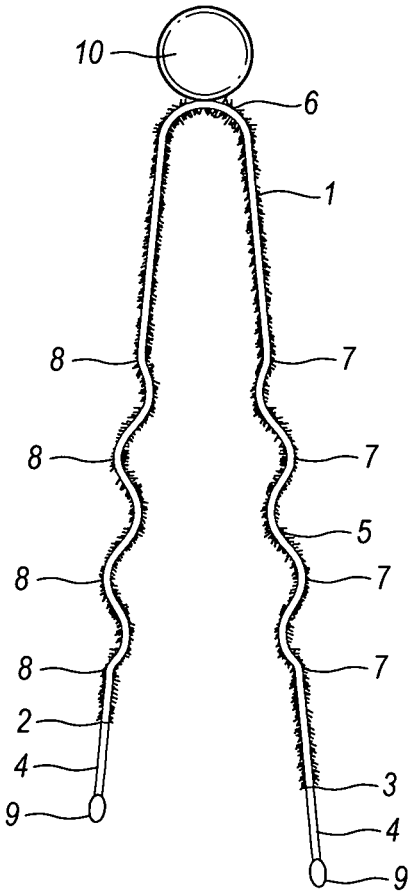
FIG. 2 illustrates a universal hairpin with a no-slip coating and detachable charm, in accordance with the exemplary embodiment.

According to one exemplary embodiment, the hairpin 1 may, advantageously, accommodate charms that can be easily replaced by a user who wants to change a charm to match a different hairstyle or an outfit. FIG. 2 illustrates a universal hairpin with a no-slip coating and detachable charm, in accordance with the exemplary embodiment. A replaceable charm 10 can be attached to the top 6 of the body of the hairpin 1 via an interface illustrated in FIGS. 5-10 that are discussed in more detail below.

Figure 3A:
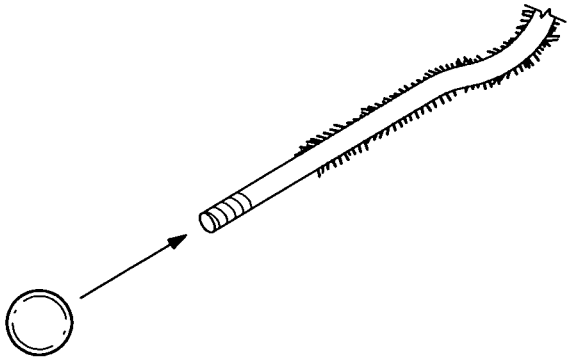
FIGS. 3A-3B illustrate how replaceable ball-shaped tips are attached to the legs of the hairpin, in accordance with the exemplary embodiment.
Figure 3B:
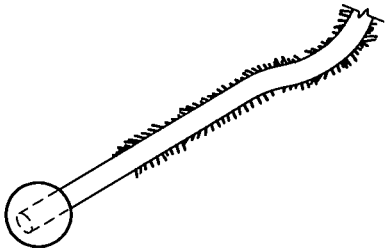
Figure 4A:
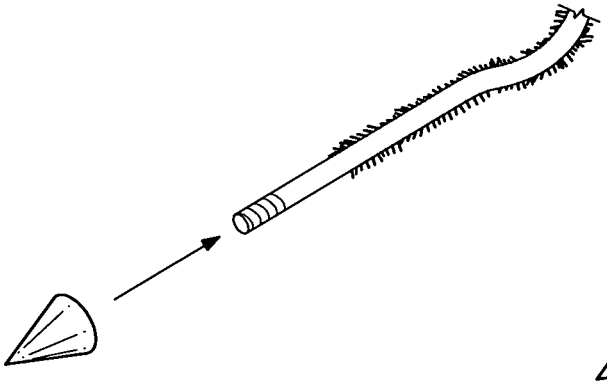
FIGS. 4A-4B illustrate how replaceable cone-shaped tips are attached to the legs of the hairpin, in accordance with the exemplary embodiment.
Figure 4B:
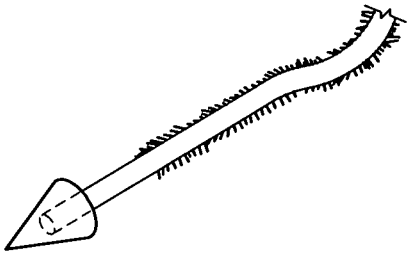

FIGS. 3A-3B illustrate how replaceable ball-shaped tips are attached to the legs of the hairpin, in accordance with the exemplary embodiment. In particular, FIG. 3A depicts an exemplary embodiment where the end of the hairpin leg is implemented as a screw and the ball-shaped tip can be simply screwed onto the end of the hairpin leg. FIG. 3B depicts an exemplary embodiment where the end of the hairpin leg has a non-slick surface and the ball-shaped tip may be simply placed on the end of the hairpin leg by a user by applying minimal pressure with her fingers. Likewise, FIG. 4A depicts an exemplary embodiment where the end of the hairpin leg is implemented as a screw and the cone-shaped tip can be simply screwed onto the end of the hairpin leg. FIG. 4B depicts an exemplary embodiment where the end of the hairpin leg has a non-slick surface and the cone-shaped tip may be simply placed on the end of the hairpin leg by a user by applying minimal pressure with her fingers. Note that the tips of any desired shape may be used with the universal hairpin disclosed herein. Those skilled in the art will appreciate that the replaceable hairpin tips of various shapes provide for better hold or for better penetration between the hairs as needed by a hairstylist or a person doing her own hair.

Figure 5:
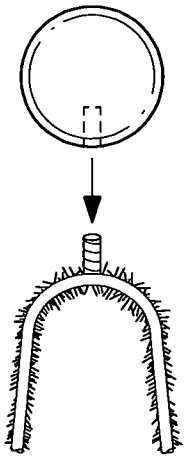
FIGS. 5-10 illustrate various implementations of an interface for attaching a replaceable charm, in accordance with the exemplary embodiment.
Figure 6:
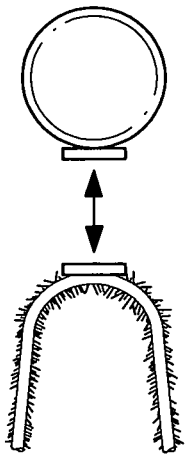

FIGS. 5-10 illustrate various implementations of an interface for attaching a replaceable charm, in accordance with the exemplary embodiment. In particular, FIG. 5 illustrates a screw interface for attaching a replaceable charm 10 shown in FIG. 2. According to this exemplary embodiment, the charm may be attached to the top 6 of the body of the hairpin 1 by being screwed onto the screw interface provided that the charm has an integrated nut that matches the diameter of the screw of the hairpin interface. FIG. 6 illustrates a magnet interface for attaching a replaceable charm 10 shown in FIG. 2. According to this exemplary embodiment, the charm may be attached to the top 6 of the body of the hairpin 1 using magnetic power of a hairpin magnet interface provided that the charm has an integrated magnet of an opposite polarity of the one of the hairpin interface.

Figure 7:
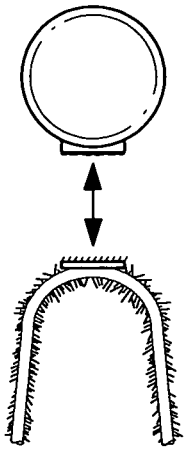
Figure 8:
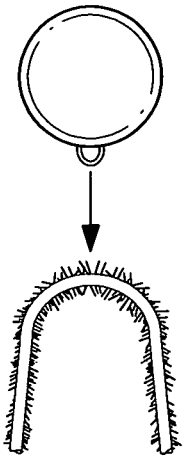
Figure 9:
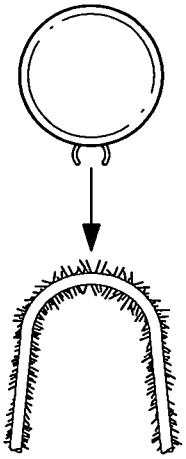
Figure 10:
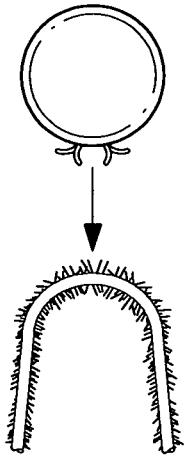

FIG. 7 illustrates a Velcro™ interface for attaching a replaceable charm 10 shown in FIG. 2. According to this exemplary embodiment, the charm may be attached to the top 6 of the body of the hairpin 1 using the Velcro™ lock interface provided that the charm has an integrated Velcro™ patch lockable with the one of the hairpin interface. FIG. 8 illustrates an embodiment for attaching the replaceable charm 10 shown in FIG. 2 to the top 6 of the body of the hairpin 1 using a ring implemented on the charm. The ring may be simply placed onto either leg of the hairpin and pulled all the way to the top. In order to do this, a use may need to remove a replaceable tip 9 from the hairpin leg 2 or 3. It is preferred that the diameter of the ring exceeds the diameter of the body of the hairpin slightly to provide for easy pulling of the charm to the top of the hairpin and yet for avoiding a very loose attachment of the charm. FIG. 9 illustrates an embodiment for attaching the replaceable charm 10 shown in FIG. 2 to the top 6 of the body of the hairpin 1 using a clip implemented on the charm (as shown) or on the body of the hairpin. In either implementation, the charm can be easily clipped into its position on the hairpin. Likewise, FIG. 9 illustrates an embodiment for attaching the replaceable charm 10 shown in FIG. 2 to the top 6 of the body of the hairpin 1 using a clamp implemented on the charm (as shown) or on the body of the hairpin. In either implementation, the charm can be easily clamped into its position on the hairpin.

Figure 11A:
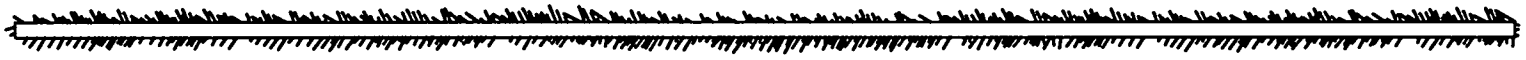
FIG. 11A illustrates a side view of a hairpin leg covered with a flock no-slip coating, in accordance with the exemplary embodiment.

FIG. 11A illustrates a side view of a hairpin leg covered with a flock no-slip coating, in accordance with the exemplary embodiment. A layer of a flocked coating may be applied onto the body of the hairpin using glue, thermal processing, spray, etc. The height of the flocks may vary depending on the hair type and on intended use of the hairpin. Micro flocks may be sufficient for some types of hair and hair styles. Yet higher or longer flocks may be needed for certain hair types and certain hairdos.

Figure 11B:
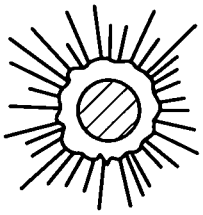
FIG. 11B illustrates a cross-section view of a hairpin leg covered with flock no-slip coating.

FIG. 11B illustrates a cross-section view of a hairpin leg covered with flock no-slip coating. As can be seen from this example, the flocks can be applied over a layer of glue or a polymer coat applied over the body of the hairpin. The flocks can be made of any suitable polymer substrate or may be made of natural hair.

Having thus described a preferred embodiment, it should be apparent to those skilled in the art that certain advantages of the described apparatus have been achieved. In particular, those skilled in the art will appreciate that the proposed hairpin is universal because it may accommodate different charms and different tips and can be used with different types of hair. The proposed hairpin is covered with a no-slip coating to provide for reliable hold suitable for dancing, aerobics, swimming, running and other activities.

It should also be appreciated that various modifications, adaptations, and alternative embodiments thereof may be made within the scope and spirit of the present invention. The invention is further defined by the following claims.

What is claimed is:

1. A universal asymmetric hairpin, comprising:

at least two legs of different length;

an interface configured to attach replaceable charms;

a layer of no-slip coating applied over the legs; and at least two replaceable tips attached to ends of the legs, wherein the ends of the legs comprise screws for screwing into the replaceable tips.

2. The universal asymmetric hairpin of claim 1, wherein the no-slip coating comprises a layer of flocked coating.

3. The universal asymmetric hairpin of claim 2, wherein the layer of flocked coating comprises a polymer material.

4. The universal asymmetric hairpin of claim 2, wherein the layer of flocked coating comprises a natural hair.

5. The universal asymmetric hairpin of claim 1, wherein the interface configured to attach replaceable charms comprises a screw.

6. The universal asymmetric hairpin of claim 1, wherein the interface configured to attach replaceable charms comprises a magnet.

7. The universal asymmetric hairpin of claim 1, wherein the interface configured to attach replaceable charms comprises a Velcro lock.

8. The universal asymmetric hairpin of claim 1, wherein the interface is configured to attach replaceable charms which comprise a clip.

9. The universal asymmetric hairpin of claim 1, wherein the interface is configured to attach replaceable charms which comprise a clamp.

10. The universal asymmetric hairpin of claim 1, wherein the interface configured to attach replaceable charms comprises a non-slip area of the hairpin configured to hold a ring affixed to the charm.

11. The universal asymmetric hairpin of claim 1, wherein the replaceable tips are of a ball shape.

12. The universal asymmetric hairpin of claim 1, wherein the replaceable tips are of a cone shape.

13. The universal asymmetric hairpin of claim 1, wherein the legs comprise waves that are offset relative to each other.

* * * * *